US007566496B2

(12) United States Patent
Jung et al.

(10) Patent No.: US 7,566,496 B2
(45) Date of Patent: Jul. 28, 2009

(54) 3-DIMENSION CRIMP POLYETHYLENE TEREPHTHALATE MULTIFILAMENT FOR CARPET

(75) Inventors: Il-Won Jung, Kyonggi-do (KR); Kyoun-Ho Kim, Kyonggi-do (KR); Jong-Bok Lee, Kyonggi-do (KR); Ik-Hyun Kwon, Kyonggi-do (KR)

(73) Assignee: Hyosung Corporation, Kyonggi-do (KR)

( * ) Notice: Subject to any disclaimer, the term of this patent is extended or adjusted under 35 U.S.C. 154(b) by 373 days.

(21) Appl. No.: 11/496,487

(22) Filed: Aug. 1, 2006

(65) Prior Publication Data

US 2007/0243379 A1 Oct. 18, 2007

(30) Foreign Application Priority Data

Apr. 14, 2006 (KR) ..... 10-2006-0033876

(51) Int. Cl.
*B32B 27/36* (2006.01)
*D02G 3/02* (2006.01)

(52) U.S. Cl. ..... 428/395; 428/364; 428/394

(58) Field of Classification Search ..... None
See application file for complete search history.

(56) References Cited

U.S. PATENT DOCUMENTS

| | | | | |
|---|---|---|---|---|
| 5,382,474 | A * | 1/1995 | Adhya et al. | 428/364 |
| 5,558,935 | A * | 9/1996 | Tanaka et al. | 428/364 |
| 2003/0167581 | A1 * | 9/2003 | Yamazaki et al. | 8/536 |
| 2006/0057373 | A1 * | 3/2006 | Inagaki et al. | 428/359 |

FOREIGN PATENT DOCUMENTS

| | | | |
|---|---|---|---|
| DE | 44 12 858 | C1 | 6/1995 |
| EP | 1 288 356 | A1 | 3/2003 |
| JP | 53-46398 | | 4/1978 |
| JP | 62-6912 | | 1/1987 |
| WO | WO 2005/005512 | A1 | 1/2005 |

* cited by examiner

*Primary Examiner*—Jill Gray
(74) *Attorney, Agent, or Firm*—Nixon & Vanderhye P.C.

(57) ABSTRACT

Disclosed is a 3-D crimp polyethylene terephthalate multifilament (BCF) having a stress-strain curve that (a) it elongates less than 5.0% when subjected to an initial stress of 1.0 g/d, (b) it has an initial modulus of 20 to 60 g/d, (c) it elongates at least 20% when subjected to a stress region of 1.0 to 2.5 g/d and (d) it elongates from a tensile strength of at least 3.0 g/d to the tensile strength at break. The BCF has improved physical properties such as excellent flame retardancy, high toughness, improved crimp uniformity and improved compressive elasticity modulus.

4 Claims, 3 Drawing Sheets

3-DIMENSION CRIMP POLYETHYLENE TEREPHTHALATE MULTIFILAMENT FOR CARPET

BACKGROUND OF THE INVENTION

1. Field of the Invention

The present invention relates to a 3-D crimp polyethylene terephthalate multifilament (Bulked Continuous Filament, hereinafter referred to as "BCF") has a stress-strain curve that (a) the 3-D crimp polyethylene terephthalate multifilament elongates less than 5.0% when subjected to an initial stress of 1.0 g/d, (b) it has an initial modulus of 20 to 60 g/d, (c) it elongates at least 20% when subjected to a stress region of 1.0 to 2.5 g/d, and (d) it elongates from a tensile strength of at least 3.0 g/d to the tensile strength at break.

2. Description of the Related Art

A synthetic fiber material of a BCF that is used to produce typical carpets is exemplified by polypropylene and polyethylene terephthalate, in addition to nylon as a representative material. Particularly, a process of producing BCF and carpets using a polyethylene terephthalate material has recently come into the spotlight. The reason is that the polyethylene terephthalate material has better characteristics than other materials in view of economic efficiency.

For flame retardancy of fibers, there are generally two methods, one of which is treatment of flame retardation to the fibers. The other method is flame retardation of a polymer using a fiber material, and this method result in lasting effect of flame retardancy. The treatment of the flame retardation to the fibers is largely applied to natural fibers such as cotton in the related art, and currently, also applied to synthetic fibers. However, the treatment of the flame retardation by the post-process result in poor durability of the fiber and environmental pollution due to wastewater generated during the treatment process, thus being tending to decrease.

Meanwhile, the method of flame retardation of the polymer is generally used a method of copolymerization to provide the fiber having the lasting flame retardancy. For copolymerization, various flame retardants having reactivity have been manufactured industrially.

Bromine- and phosphorus-based flame retardants are frequently applied to produce the polyethylene terephthalate having flame retardancy using the copolymerization. Japanese patent laid-open publication Nos. 1987-6912 and 1978-46398 is disclosed the bromine-based flame retardant. Since a bromine-based compound is easily thermally decomposed at high temperatures, the compound is necessary to be added in a great amount in order to obtain effective flame retardancy. Thus, the polymer is discolored and has deteriorated light-fastness. Furthermore, recently, the possibility of generation of a carcinogenic substance such as dioxin and benzofuran has been suggested, thus there is an attempt to restrict the use of the bromine-based compound. Currently, replacement into the phosphorus-based flame retardant is actively conducted.

SUMMARY OF THE INVENTION

The present invention has been finalized in order to improve the flame retardancy and a toughness of a polyethylene terephthalate grey yarn for the conventional BCF. Accordingly, an object of the present invention is to provide a 3-D crimp polyethylene terephthalate multifilament having high flame retardancy and toughness, by using a polyethylene terephthalate polymer of flame retardancy containing a phosphorus-based flame retardant of 0.05 to 5 wt % based on a phosphorus atom, elongating a single step or two steps when a multifilament is elongated, and using a steam jet- or air jet-type texturing process, thus the 3-D crimp polyethylene terephthalate multifilament has high toughness that it elongates at least 20% or more in a stress region of 1.0 to 2.5 g/d.

In order to achieve the above object, the 3-D crimp polyethylene terephthalate multifilament of the invention has an intrinsic viscosity of 0.4 to 1.0, contains a phosphorus-based flame retardant of 0.05 to 5 wt % based on a phosphorus atom, and has a stress-strain curve that (a) the 3-D crimp polyethylene terephthalate multifilament elongates less than 5.0% when subjected to an initial stress of 1.0 g/d, (b) it has an initial modulus of 20 to 60 g/d, (c) it elongates at least 20% when subjected to a stress region of 1.0 to 2.5 g/d, and (d) it elongates from a tensile strength of at least 3.0 g/d to the tensile strength at break.

Furthermore, the multifilament preferably includes 30 to 150 filaments.

Additionally, a limited oxygen index (LOI) of the 3-D crimp polyethylene terephthalate multifilament is 25 or more.

Additionally, the phosphorus-based flame retardant is a compound represented by the following Formula (1) or (2):

(1)

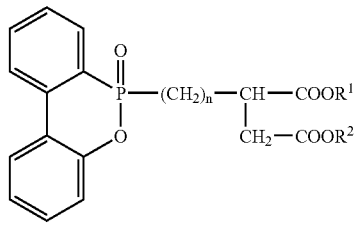

wherein $R^1$ and $R^2$ are hydrogen atoms, or the same or different radicals containing a ω-hydroxyl group having 2 to 4 carbon atoms, and n is an integer ranging from 1 to 5; and (2)

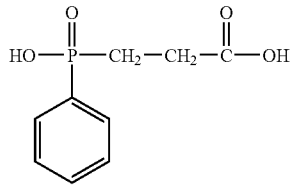

Additionally, the 3-D crimp polyethylene terephthalate multifilament of the invention is characterized in that a crimp standard deviation is 5% or less.

Additionally, the invention provides a carpet having excellent bulkiness, which comprises the 3-D crimp polyethylene terephthalate multifilament.

DESCRIPTION OF THE PREFERRED EMBODIMENTS

Hereinafter, a 3-D crimp polyethylene terephthalate multifilament for a carpet according to the present invention and a method of producing the same will be described in more detail referring to the accompanying drawings.

In disclosure of the present invention, it is to be understood that the terminology used therein is for the purpose of describing particular embodiments only, and depends on the purpose or usage of those skilled in the art, thus being not to be construed to limit constitutions of the present invention.

Figure 1:
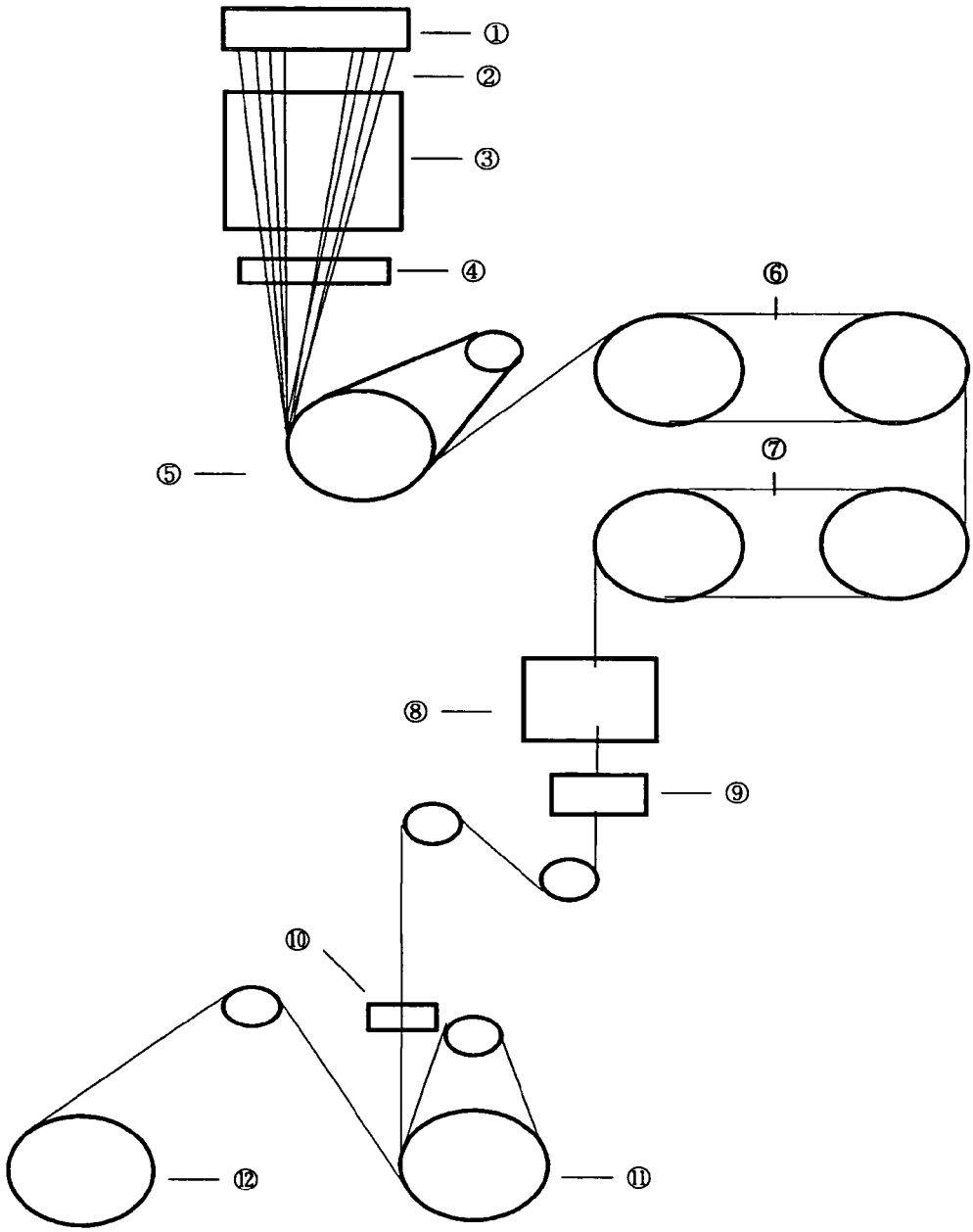
FIG. 1 is a schematic view illustrating a device for producing a 3-D crimp polyethylene terephthalate multifilament according to the invention.
Figure 2A:
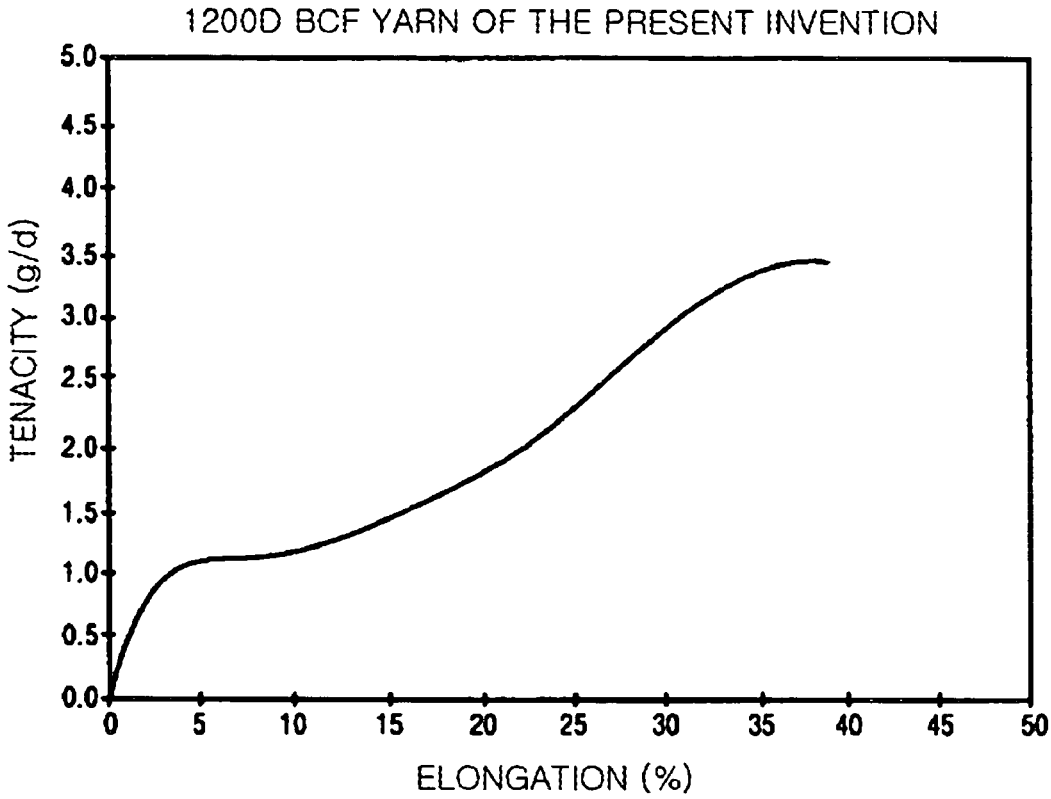
FIG. 2*a* is a graph showing a strength-elongation curve for the 3-D crimp polyethylene terephthalate multifilament produced according to the invention.
Figure 2B:
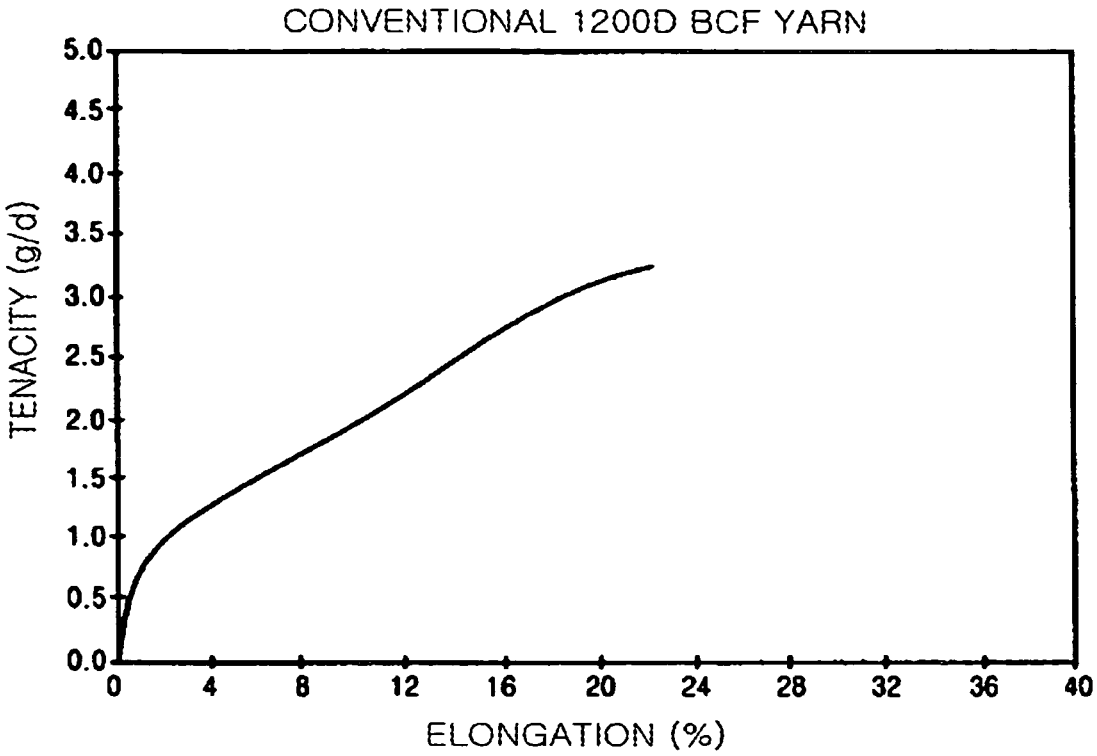
FIG. 2*b* is a graph showing a strength-elongation curve for a conventional 3-D crimp polyethylene terephthalate multifilament.

FIG. 1 is a schematic view illustrating a device for producing a polyethylene terephthalate BCF according to the invention.

First, a polyethylene terephthalate polymer that has an intrinsic viscosity of 0.4 to 1.0 and contains a phosphorus-based flame retardant of 0.05 to 5 wt % based on a phosphorus atom is melt spun at 245 to 335° C., and passes through a spinneret 1.

A polyethylene terephthalate resin which is a basic substance of the invention contains 90 mole % or more of ethylene terephthalate as repeating units.

The phosphorus-based flame retardant is a compound represented by the following Formula (1) or (2):

(1)

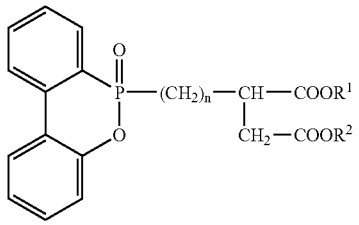

in Formula (1), $R^1$ and $R^2$ are hydrogen atoms, or the same or different radicals containing a ω-hydroxyl group having 2 to 4 carbon atoms, and n is an integer ranging from 1 to 5; and (2)

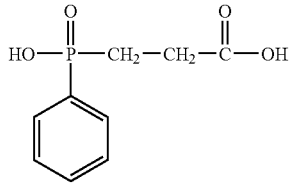

The content of the phosphorus-based flame retardant represented by the compound of Formula (1) or (2) is 0.05 to 5 wt %, preferably 0.1 to 2 wt % of the polymer, based on the phosphorus atom. If the content of the phosphorus atom is less than 0.05 wt %, flame retardancy is reduced. If the content is more than 5 wt %, the degree of polymerization of polyester is reduced, causing deterioration in physical properties of a BCF yarn.

Next, cooling is conducted using air at speed of 0.2 to 1.0 m/sec in a cooling zone 3. The cooling temperature is controlled to 10 to 35° C. If the speed of cooling air is less than 0.2 m/sec, a cooling efficiency is insufficient. If the speed is more than 1.0 m/sec, the yarn is excessively shaken, thus reducing spinning efficiency. Additionally, if the cooling temperature is lower than 10° C., it is undesirable in view of economic efficiency, and if the temperature is higher than 35° C., cooling efficiency is reduced.

After the cooling, a spin finish step is conducted to carry out oiling. The oiling is conducted through first and second steps using a neat-type oiling agent or a water-soluble oiling agent in a finish applicator 4 to increase collecting ability, lubricating ability, and smoothness of the yarn.

Next, filaments are supplied from a supplying roller 5 to drawing rollers 6 and 7 at speed of 100 to 1,000 m/min, and preferably 400 to 800 m/min. The filament is drawn at the drawing speed of 2.5 to 6.0 times, preferably 3.5 to 5.0 times, as fast as that of the supplying roller 5 under the condition where the temperature of the drawing rollers 6 and 7 is 100 to 230° C. If the drawing speed is less than 2.5 times, the drawing is not sufficient, and, if the speed is more than 6.0 times, a polyethylene terephthalate material cannot endure the drawing due to its physical characteristics, causing yarn cutting.

The filament that passes through the drawing roller passes through a texturing unit 8 having a texturing nozzle to provide bulk property. At this time, a heating fluid at 150 to 270° C. is sprayed at pressure of 3 to 10 kg/cm$^2$ in the texturing unit to crimp the filament so as to have an irregular 3-D shape, the crimp percent is set to 3 to 50%.

It is preferable that the temperature of the heating fluid is 150 to 270° C. If the temperature is lower than 150° C., a texturing effect is reduced. If the temperature is higher than 270° C., damage to the filament is caused. Furthermore, it is preferable that pressure of the heating fluid be 3 to 10 kg/cm$^2$. If the pressure is less than 3 kg/cm$^2$, the texturing effect is reduced, and, if the pressure is more than 10 kg/cm$^2$, damage to the filament is caused.

The filaments that pass through the texturing unit are cooled in the course of passing through the cooling zone 9, and then pass through an interlacing machine 10. In this machine, in order to increase collecting ability of the yarn, slight twisting and knotting are provided at pressure of 2.0 to 8.0 kg/m$^2$ in the ratio of 0 to 40 times/m, and preferably 10 to 25 times/m. If interlacing is conducted more than 40 times, an interlaced portion is not unknotted but maintained even after dyeing and post-processing, thus an appearance of the carpet is deteriorated.

Next, the filaments pass through a relaxing roller 11 at the speed that is 0.65 to 0.95 times as fast as that of the drawing roller so as to provide the relax ratio of 5 to 35%, and is then wound using a final winder 12. The speed of the winder is typically controlled so that tension of a thread is 50 to 350 g. If the tension on the winder is less than 50 g, it is impossible to conduct the winding. If the tension is more than 350 g, a bulk property is reduced, a grey yarn is significantly shrunken, and the tension is high, thus reducing workability. Furthermore, if the speed of the relaxing roller is less than 0.65 times the speed of the drawing roller, the winding is impossible, and, if the speed of the relaxing roller is more than 0.95 times the speed of the drawing roller, the bulk property is reduced, the grey yarn is significantly shrunken, and the tension is high, thus reducing workability.

The above-mentioned method relates to the BCF produced only using the polyethylene terephthalate resin, but the processes of each step are the same as the above processes when the different dope dyed yarns are produced according to the purpose of carpet. With respect to the supply of raw materials, it is possible to produce the dope dyed yarns by adding a predetermined amount of coloring agent to a predetermined amount of base chips to conduct the spinning.

The invention is characterized in that a most desirable stress-strain curve for the polyethylene terephthalate multifilament is designed so as to absorb friction or impact energy transferred to the 3-D crimp polyethylene terephthalate multifilament which is typically applied to the carpet. In connection with this, the stress-strain curve for the polyethylene terephthalate multifilament that is obtained at normal temperature preferably shows an elongation of less than 5.0% under initial stress of 1.0 g/d, an initial modulus of 20 to 60 g/d, an elongation of at least 20% in a stress region of 1.0 to 2.5 g/d, and an elongation under tensile strength of at least 3.0 g/d to a point of break.

In order to safely absorb impact energy transferred when using the carpet, it is necessary for the polyethylene terephthalate multifilament to have the high initial modulus so as to minimize strain under low stress. It is preferable that the polyethylene terephthalate multifilament of the invention be elongated to be less than 5.0% under the initial stress of 1.0 g/d. If the multifilament is elongated to be 5% or more when subjected to the low stress of 1.0 g/d, the carpet is significantly strained.

Furthermore, it is preferable that the polyethylene terephthalate multifilament of the invention be elongated to at least 20% in the stress region of 1.0 to 2.5 g/d. If the elongation is less than 20%, an impact absorption region corresponding to toughness is small, thus damage caused by friction is significant.

Additionally, it is preferable that the polyethylene terephthalate multifilament be elongated under tensile strength of at least 3.0 g/d to a point of break to reduce a weight of the carpet. If the yarn is broken under the tensile strength of 3.0 g/d or less, tensile strength and tear strength of final carpet products are poor.

The invention is characterized in that a chip containing 0.05 to 5 wt % of the flame retardant based on a phosphorus atom is used to produce a fiber so that it elongates at least 20% in the stress region of 1.0 to 2.5 g/d. A phosphorus- or halogen-based flame retardant may be used as the flame retardant. Particularly, the phosphorus-base flame retardant is preferable. The phosphorus-based flame retardant improves flame retardancy of multifilament or fiber. Further the phosphorus-based flame retardant acts as a plasticizer during the process of fibers, thus it affects the stress-strain curve, particularly, it bring the elongation in the stress region of 1.0 to 2.5 g/d to increase.

With respect to other factors affecting the stress-strain curve for the polyethylene terephthalate multifilament of the invention, it is necessary to optimize cooling so that the polyethylene terephthalate multifilament has, at most, an amorphous and unoriented structure when the multifilament passes through the cooling zone 3, and to maintain the supplying roller at a predetermined temperature or higher so as to prevent cold-crystallization, thereby desirably achieving the drawing.

Further factors affecting the stress-strain curve are an oiling agent, a spinning speed, and a drawing ratio.

The factors affecting the stress-strain curve may be organically combined to design the most desirable stress-strain curve.

The 3-D crimp polyethylene terephthalate multifilament that is produced according to the invention as described above is subjected to a post-process to produce the carpet. The carpet may be produced through the method known in the art using the BCF yarn of the invention. Preferably, a plurality of BCF yarns is subjected to cable twisting and thermal fixing processes, and then woven with respect to first rear sides. Subsequently, a latex adhesive is applied on second rear sides. A cut or loop pile type of carpet may be produced so as to have a pile height of about 2 to 20 mm. The weight of the carpet is 400 to 4000 g/m$^2$.

A better understanding of the present invention may be obtained in light of the following Examples which are set forth to illustrate, but are not to be construed to limit the present invention.

<Evaluation of Physical Properties of the 3-D Crimp Polyethylene Terephthalate Multifilament>

1) Intrinsic Viscosity (I.V.)

0.1 g of a sample was dissolved in a reagent containing a mixture of phenol and 1,1,2,3-tetrachloroethanol in a weight ratio of 6:4 (90° C.) for 90 minutes so that the concentration was 0.4 g/100 ml, and the solution was transferred to an Ubbelohde viscometer and then maintained in a thermostat at 30° C. for 10 minutes. The number of solution drops per second as well as solvent was obtained using a viscometer and an aspirator. Then the R.V. value and the I.V. value are calculated according to the following equations:

$$R.V.=\text{the number of sample drops per second/the number of solvent drops per second}$$

$$I.V.=\tfrac{1}{4}\times(R.V.-1)/C+\tfrac{3}{4}\times(\ln R.V./C)$$

In the above equation, C denotes the concentration (g/100 ml) of the sample in the solution.

2) Strength and Elongation

The test was conducted using a KS, K 0412 (test method of strength and elongation of a filament yarn) method, and the test were measured in accordance with at conditions included a sample length of 20 cm, a tensile speed of 200 mm/min, an initial load of 20 g, and 8 turns per 10 cm.

3) Crimp Percent and Standard Deviation

Measurement is conducted 5 times in accordance with using a TYT-EW (Textured Yarn Tester) at a measurement length of 20 m, a measurement interval of 2 m, a heating zone at 130° C., and a measurement speed of 20 m/min.

4) Denier

A weight (g) of the grey yarn having a length of 9,000 m

5) Compressive Elasticity Modulus

A load of 1 kg is applied to an upper part of the carpet and then a pile height of the carpet is measured after 5 min. A ratio of a compression height to the pile height before loading is referred to as compressibility. Then the load is removed to the same sample and the pile height for same sample is measured after 5 min. A ratio of the pile height after the removal of loading to the pile height before loading is compressive elasticity modulus.

6) Flame Retardancy

The obtained fiber was tested in accordance with a KS M 3032 method in Korea to evaluate a LOI (Limited Oxygen Index).

Example 1

Slurry that was prepared using 8650 g of terephthalic acid (TPA) and 2700 g of ethylene glycol (EG) was subjected to esterification using a semibatch process. The temperature of an esterification reactor was maintained at 250 to 260° C. Produced oligomers were transferred to a polycondensation reactor. A solution in which 65 wt % substance of Formula (1) where n is 1 and $R^1$ and $R^2$ are $CH_2CH_2OH$ was dissolved in EG was used as a flame retardant. After 1580 g of flame-retardant solution was added, manganese acetate and phosphoric acid were added as UV stabilizers in amounts of 50 ppm and 45 ppm based on manganese and phosphorus atoms. 200 g of a 2 wt % solution of antimony trioxide in EG was added as a catalyst to conduct polycondensation, thereby a polymer having an intrinsic viscosity (IV) of 0.65 dl/g is obtained The polyethylene terephthalate polymer having the intrinsic viscosity (IV) of 0.65 and a moisture content of 120 ppm was melt spun through a spinneret having 68 holes and a Y-shaped section at 275° C. The polymer that was discharged from the spinneret was cooled by means of cooling air flowing at a rate of 0.5 m/s at 20° C. at a lower part of a nozzle, and then passed through an oiling agent feeding device. A grey yarn to which the oiling agent was added passed through a supplying roller at 90° C. at a rate of 598 m/min, and was then drawn at a rate of 2,840 m/min using drawing rollers at 170° C. The grey yarn passed through the drawing rollers passed through a texturing nozzle to have crimp. In this, the steam temperature was 183° C., the pressure was 4.8 kg/cm$^2$, and the back pressure was 2.5 kg/cm$^2$. Subsequently, cooling was conducted using cooling water, and interlacing was conducted under the pressure of 4.0 kg/m$^2$ in a ratio of 20 times/m in a collector. The yarn passed through a relaxing roller at a rate of 2250 m/min to be relaxed to the degree of about 21%, and wound using a winding machine. Denier, strength, and crimp of the polyethylene terephthalate BCF grey yarn that was produced through the above procedure were measured, and the results were shown in Tables 1 and 2.

Example 2

The spinning was conducted using the same polymer as Example 1, but the rates of the supplying roller, the drawing rollers, and the relaxing roller were set to be different from those of Example 1 to produce a flame-retardant PET BCF having denier, strength, and the elongation that were different from those of Example 1.

After the polymer was subjected to a spin finish step, the polymer passed through the supplying roller at 95° C. at a rate of 532 m/min, and was then drawn at a rate of 2820 m/min using the drawing rollers. The temperature of the drawing rollers was 160° C. The grey yarn that passed through the drawing rollers passed through a texturing nozzle to have crimp. In this, the temperature of steam was 208° C., the pressure was 4.8 kg/cm$^2$, and the back pressure was 2.5 kg/cm$^2$. Subsequently, cooling was conducted using cooling water, and interlacing was conducted at pressure of 4.0 kg/m$^2$ in a ratio of 16 times/m in a collector. The yarn passed through the relaxing roller at a rate of 2275 m/min to be relaxed to the degree of about 24%, and wound using a winding machine. Denier, strength, and crimp of the polyethylene terephthalate BCF grey yarn that was produced through the above procedure were measured, and the results were shown in Tables 1 and 2.

Example 3

The spinning was conducted under the same conditions as Example 1 to produce a dope dyed yarn except that 3 wt % of a color masterbatch was added based on the amount of base chips added in the course of feeding raw materials so as to conduct blending spinning.

Example 4

Slurry that was prepared using 8650 g of terephthalic acid (TPA) and 2700 g of ethylene glycol (EG) was subjected to esterification using a semibatch process. The temperature of an esterification reactor was maintained at 250 to 260° C. Produced oligomers were transferred to a polycondensation reactor. A solution in which 65 wt % of the phosphorus-based flame retardant of Formula (2) was dissolved in EG was used as a flame retardant. After the flame retardant was added so that the phosphorus content of the flame retardant was 0.6 wt % based on the total weight of the BCF grey yarn, manganese acetate and phosphoric acid were added as UV stabilizers in amounts of 50 ppm and 45 ppm based on manganese and phosphorus atoms. 200 g of a 2 wt % solution of antimony trioxide in EG was added as a catalyst to conduct polycondensation, thereby a polymer having an intrinsic viscosity (IV) of 0.65 dl/g is obtained.

The polyethylene terephthalate polymer having the intrinsic viscosity (IV) of 0.65 and a moisture content of 120 ppm was melt spun through a spinneret having 68 holes and a Y-shaped section at 275° C. The polymer that was discharged from the spinneret was cooled by means of cooling air flowing at a rate of 0.5 m/s at 20° C. at a lower part of a nozzle, and then passed through an oiling agent feeding device. The grey yarn to which the oiling agent was added passed through a supplying roller at 90° C. at a rate of 598 m/min, and was then drawn at a rate of 2,840 m/min using drawing rollers at 170° C. The grey yarn passed through the drawing rollers passed through a texturing nozzle to have crimp. In connection with this, the steam temperature was 183° C., the pressure was 4.8 kg/cm$^2$, and the back pressure was 2.5 kg/cm$^2$. Subsequently, cooling was conducted using cooling water, and interlacing was conducted under the pressure of 4.0 kg/m$^2$ in a ratio of 20 times/min a collector. The yarn passed through a relaxing roller at a rate of 2250 m/min to be relaxed to the degree of about 21%, and wound using a winding machine. Denier, strength, and crimp of the polyethylene terephthalate BCF grey yarn that was produced through the above procedure were measured, and the results were shown in Tables 1 and 2.

Example 5

The spinning was conducted using the same polymer as Example 4, but the rates of the supplying roller, the drawing rollers, and the relaxing roller were set to be different from those of Example 4 to produce a flame-retardant PET BCF having denier, strength, and the elongation that were different from those of Example 4.

After the polymer was subjected to a spin finish step, the polymer passed through the supplying roller at 95° C. at a rate of 532 m/min, and was then drawn at a rate of 2820 m/min using the drawing rollers. The temperature of the drawing rollers was 160° C. The grey yarn that passed through the drawing rollers passed through a texturing nozzle to have crimp. In connection with this, the temperature of steam was 208° C., the pressure was 4.8 kg/cm$^2$, and the back pressure was 2.5 kg/cm$^2$. Subsequently, cooling was conducted using cooling water, and interlacing was conducted at pressure of 4.0 kg/m$^2$ in a ratio of 16 times/m in a collector. The yarn passed through the relaxing roller at a rate of 2275 m/min to be relaxed to the degree of about 24%, and wound using a winding machine. Denier, strength, and crimp of the polyethylene terephthalate BCF grey yarn that was produced through the above procedure were measured, and the results were shown in Tables 1 and 2.

Example 6

The spinning was conducted under the same conditions as Example 4 to produce a dope dyed yarn except that 3 wt % of a color masterbatch was added based on the amount of base chips added in the course of feeding raw materials so as to conduct blending spinning.

Comparative Example 1

The spinning was conducted using a pure polyethylene terephthalate polymer not containing phosphorus-based flame retardant under the same conditions as Example 1. Denier, strength, crimp, and LOI of the resulting grey yarn were measured, and the results were shown in Tables 1 and 2.

TABLE 1

| | Denier | Strength (g/d) | Crimp (%) | Crimp standard deviation (%) | Phosphorus content (wt %) | Flame retardancy (LOI) |
|---|---|---|---|---|---|---|
| Ex. 1 | 1252 | 3.32 | 17 | 3.5 | 0.6 | 30.3 |
| Ex. 2 | 1440 | 3.76 | 19 | 4.1 | 0.6 | 30.5 |
| Ex. 3 | 1245 | 3.11 | 16 | 3.8 | 0.6 | 30.5 |
| Ex. 4 | 1240 | 3.46 | 17 | 3.4 | 0.6 | 31.2 |
| Ex. 5 | 1420 | 3.86 | 19 | 4.0 | 0.6 | 31.4 |
| Ex. 6 | 1220 | 3.21 | 16 | 3.7 | 0.6 | 31.3 |
| Comp. Ex. 1 | 1242 | 3.16 | 16 | 5.2 | 0 | 23.8 |

In Table 1, since the BCF yarns were produced under the same spinning condition in Examples 1 and 3 and Comparative Example 1, physical properties such as strength and the crimp percent are not significantly different. In Example 2 where the drawing ratio and the relaxing were different from those of the above-mentioned Examples, strength is relatively high. The same results are obtained in Examples 4, 5, and 6 using the compound of Formula (2) as the phosphorus-based flame retardant.

The polyester polymer containing the flame retardant was used in Examples 1, 2, and 3, but pure polyester was used in Comparative Example 1, and thus there is a significant difference in the LOI. Furthermore, it can be seen that Examples 1, 2, and 3 have a lower crimp standard deviation than Comparative Example 1 even though the spinning condition is constant. The same results are obtained in Examples 4, 5, and 6 using the compound of Formula (2) as the phosphorus-based flame retardant.

TABLE 2

| | Stress-strain curve for 3-D crimp polyethylene terephthalate multifilament | | |
|---|---|---|---|
| | Elongation at 1.0 g/d (%) | Elongation in a stress region of 1.0 to 2.5 g/d (%) | Elongation under stress of 3.0 g/d to the point of break (%) |
| Ex. 1 | 3% | 24% | 7% |
| Ex. 2 | 3% | 21% | 8% |
| Ex. 3 | 3% | 26% | 5% |
| Ex. 4 | 3% | 25% | 6% |
| Ex. 5 | 3% | 22% | 7% |
| Ex. 6 | 3% | 25% | 5% |
| Comp. Ex. 1 | 2% | 12% | 4% |

Example 7

A carpet was produced using the BCF grey yarn of Example 1 according to the above-mentioned procedure under the following conditions, and the compressive elasticity modulus was measured. The results were shown in Table 3.

Crimp percent of the grey yarn: 17%
Pile height: 11 mm
Stitch length: 12.8 stitches/in
Gauge length: 1/10 Gauge Comparative Example 2

The carpet was obtained using the BCF grey yarn which was produced through to the same procedure using a pure polyester polymer under the same condition as Example 7, and the compressive elasticity modulus and the flame retardancy were measured. The results were shown in Table 3.

TABLE 3

| | Compressibility | Elasticity | Flame retardancy |
|---|---|---|---|
| Ex. 7 | 38.4% | 90.7% | 30.7 |
| Comp. Ex. 2 | 38.3% | 90.9% | 23.6 |

As described above, a 3-D crimp polyethylene terephthalate multifilament according to the invention has high flame retardancy.

What is claimed is:

1. A 3-D crimp polyethylene terephthalate multifilament prepared by spinning a polyethylene terephthalate polymer which contains 90 mol % or more of ethylene terephthalate as a repeating unit, the 3-D crimp polyethylene terephthalate multifilament having an intrinsic viscosity of 0.4 to 1.0 and containing 0.05 to 5 wt % of a phosphorus-based flame retardant based on a phosphorus atom which is a compound represented by the following Formula (1) or Formula (2)

Formula (1):

(1)

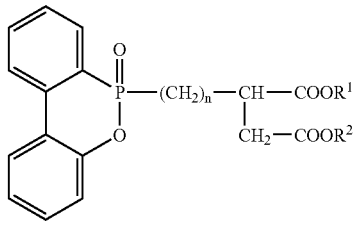

wherein $R^1$ and $R^2$ are hydrogen atoms, or the same or different radicals containing a ω-hydroxyl group having 2 to 4 carbon atoms, and n is an integer ranging from 1 to 5, Formula (2):

(2)

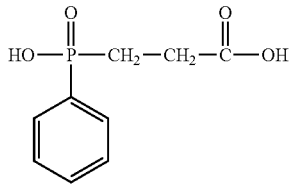

wherein the 3-D crimp polyethylene terephthalate multifilament has a stress-strain curve that (a) it elongates less than 5.0% when subjected to an initial stress of 1.0 g/d, (b) it has an initial modulus of 20 to 60 g/d, (c) it elongates at least 20% when subjected to a stress region of 1.0 to 2.5 g/d and (d) it elongates from a tensile strength of at least 3.0 g/d to the tensile strength at break.

2. The 3-D crimp polyethylene terephthalate multifilament according to claim 1, wherein the multifilament includes 30 to 150 filaments.

3. The 3-D crimp polyethylene terephthalate multifilament according to claim 1, wherein a limited oxygen index (LOI) of the 3-D crimp polyethylene terephthalate multifilament is 25 or more.

4. A carpet comprising the 3-D crimp polyethylene terephthalate multifilament according to claim 1.

* * * * *